US007867021B1

(12) United States Patent
Brant

(10) Patent No.: US 7,867,021 B1
(45) Date of Patent: Jan. 11, 2011

(54) VEHICLE POWER CONNECTION DEVICE FOR ACCESSORIES

(76) Inventor: Gregory S. Brant, 721 209th Avenue Ct. East, Lake Tapps, WA (US) 98391

( * ) Notice: Subject to any disclaimer, the term of this patent is extended or adjusted under 35 U.S.C. 154(b) by 0 days.

(21) Appl. No.: 12/719,603

(22) Filed: Mar. 8, 2010

(51) Int. Cl.
*H01R 4/40* (2006.01)

(52) U.S. Cl. ..... 439/504; 439/798

(58) Field of Classification Search ..... 439/504, 439/796–798
See application file for complete search history.

(56) References Cited

U.S. PATENT DOCUMENTS 4,577,917 A * 3/1986 Nashimoto et al. ..... 439/655
4,846,733 A 7/1989 Baisz et al.
5,690,515 A * 11/1997 Cipolla ..... 439/797
5,713,766 A 2/1998 Davies et al.
5,823,810 A 10/1998 Takahashi
6,162,097 A 12/2000 Liang
6,162,990 A 12/2000 Sakamoto
6,459,233 B1 * 10/2002 Liang ..... 320/105
6,461,171 B2 10/2002 Kanaoka et al.
7,033,209 B2 * 4/2006 Swiatek et al. ..... 439/502
7,335,054 B2 * 2/2008 Nakazawa et al. ..... 439/511
7,615,885 B2 * 11/2009 Puschkat ..... 307/10.1

* cited by examiner

*Primary Examiner*—Gary F. Paumen

(57) ABSTRACT

A vehicle power connection device that branches a single pair of connections to a vehicle's battery to provide power to a plurality of accessories. The device having a housing being made of an insulating material and possessing a plurality of pairs of power output sockets, each pair having both a positive member and a negative member in close proximity to each other. Each of the power wires of the accessories are individually secured into the sockets of the housing, in a manner so as to shield the un-insulated portion of the inserted wire from accidental contact with another electrically conducting member of the vehicle. The device also having a circuit protection mechanism to stop electrical communication between the vehicle and the accessory load if a circuit fault condition occurs. Various embodiments of the above are disclosed.

6 Claims, 6 Drawing Sheets

VEHICLE POWER CONNECTION DEVICE FOR ACCESSORIES

BACKGROUND

1. Technical. Field

The present disclosure relates to providing power for vehicle accessories and, more particularly, to a vehicle power connection device that couples to an electrical system of a vehicle to provide power to accessories that are not configured to directly plug into the vehicle's factory installed wiring harness.

2. Description of the Related Art

Many powered accessories for use with motor vehicles are added after the vehicle has left the factory, and are therefore referred to as aftermarket accessories. It is not uncommon for example for a motorcycle rider to have multiple aftermarket accessories such as LED display lights, alarm system, stereo system, GPS, heated riding apparel, and others.

Several approaches exist for providing power from the vehicle to the accessory. One approach is to couple the power wires of the accessory directly to an existing accessory circuit at the fuse block of the vehicle. The two drawbacks to this approach is this usually requires the accessory being attached to have a mating connector to the fuse block, and not all vehicles have unused circuits available. This is especially true for vehicles such as motorcycles, Personal Water Craft (PWCs), snowmobiles, and All Terrain Vehicles (ATVs), which many times are not pre-wired with accessory circuits.

A second approach is to tap or splice into a wire of the wiring harness of the vehicle which is currently providing power to an existing electrical member of the vehicle. The first drawback of this approach is it requires an understanding of which wires of the wiring harness provide continuous power. Secondly, that by sharing the load with an existing electrical member, the additional load from the accessory may cause the circuit to exceed the maximum load for which it was designed. This approach often requires an installer to cut or splice into the wiring of the vehicle, which many consumers are reluctant to do. Attaching a plurality of accessory loads requires numerous tapping or splicing.

A third approach is to install an additional device on the vehicle for the purpose of power connection of accessories. Numerous aftermarket fuse blocks exist for vehicles, however they also require a knowledge of the vehicle's wiring and a wiring skills beyond the comfort level of many consumers. Additionally their design is focused primarily toward the automotive market, so the overall size of the device and terminal connectors able to couple to the device are not optimized for use on motorcycles, ATVs, PWCs, and snowmobiles. Additionally, since many aftermarket accessories are factory equipped with an in-line fuse to protect the accessory, using a fuse block typically means adding an additional fuse per accessory. The second fuse per accessory adds little protection, but increases the size required for the power connection device. U.S. Pat. No. 4,577,917 to Nashimoto et al. discloses a device that is sufficiently small in size to be used on the above referenced vehicles, but it doesn't accommodate ring terminals, or stripped wires without connector terminals, and the device lacks a locking or securing mechanism for accessory wires which are coupled to the device.

U.S. Pat. No. 7,615,885 to Puschkat, and U.S. Pat. No. 6,459,233 to Liang both disclose devices for a plurality of loads which provide the ease of use of a direct battery terminal coupling. However the devices attaches to only one battery terminal, and therefore provides only one polarity. Additionally, the devices lacks the ability to be positioned where space on the vehicle is available.

U.S. Pat. No. 7,335,054 to Nakazawa et al. disclose a device which provides flexibility in the location of the device on the vehicle, however it also provides only a single polarity, and also requires a mating connector of the type not typically found on accessories.

A fourth approach is to couple the accessory to the electrical system of the vehicle using the cigarette lighter, or a similarly configured power port, which are increasing common in newer cars. This allows the ability to easily add or remove an accessory using a commonly used plug. The drawbacks of this approach include that many vehicles, especially motorcycles, snowmobiles, ATVs, PWCs, etc do not come equipped with either a cigarette lighter or power port, and if they do, the number they possess is often one or two. U.S. Pat. No. 7,033,209 to Swiatek et al. discloses an approach provide a plurality of cigarette lighter power ports where an insufficient number exist, however, the approach also shows the limiting, bulky nature of a device that provides a plurality of this type of power interconnect. The size of the device prevents it from being used in a location that is hidden from sight, for example under the seat of a motorcycle.

Due to the drawbacks of the above mentioned approaches, one of the most common approaches used by many manufacturers of accessories is to couple the power wires of the accessories directly to the battery using ring terminals or a similar style connector on the power load wires. This approach requires little space, and ensures the accessory can couple to a broad range of vehicles without modification, or needing to accommodate the broad range of connector types used on factory vehicle fuse blocks.

FIG. 1 illustrates a vehicle battery 20 which has a load 22 electrically coupled to the battery terminal 24. The battery terminal bolt 26, which threads into the battery terminal 24, passes through a ring terminal 28 on the terminating end of the load 22 to affix it to the side of the battery terminal 24. The advantage of using ring terminals coupled to the vehicle's battery is it is often faster and easier than determining how and where to splice or tap into the factory wiring harness. This is often the only option for vehicles such as motorcycles, PWCs, snowmobiles, and ATVs, all of which may have limited or no factory installed accessory power wiring.

Several drawbacks do exist with using ring terminals or similar connectors directly coupled to the battery as the power source for accessories. In order to install or remove an accessory, the battery terminal bolts must be loosened. This also affects the power connections of all other loads already installed on the battery, as the pressure that creates consistent contact between battery and the ring terminal of all existing accessories must be relaxed in order to add or remove any one of the ring terminals. This in turn can cause a momentary loss of power to those electrical members of the vehicle resulting in a possible loss of user selected settings, or in the triggering of a vehicle alarm.

Over time the pressure from the repeated tightening and loosening of the battery terminal bolts in order to install or remove accessories will cause the already attached ring terminals to elongate and distort, reducing the contact area with the battery terminal, thereby reducing the quality of the electrical connection.

Additionally, when ring terminals or similar connectors are stacked on each other only the ring terminal immediately adjacent to the battery terminal contact surface has a direct connection to the battery. The accessory ring terminals that are not immediately adjacent to the battery terminal contact surface establish an electrical connection to the battery by contacting with an adjacent ring terminal that establishes a series connection with the battery. FIG. 2 illustrates a side view of the vehicle battery terminal 24 with the primary vehicle power load ring terminal 28 and the ring terminals for three separate accessories 30, 32, and 34. A gap is shown between the ring terminals for clarity of illustration. In actual application the terminals would be tightly sandwiched together. In this example accessory ring terminal 32 establishes an electrical connection to the battery terminal 24 through a series coupling comprised of accessory ring terminal 30 and the primary vehicle load ring terminal 28, and a second series coupling including accessory ring terminal 34. This series connection becomes problematic if any corrosion is present on the surface of the ring terminals, as is typical in vehicle applications exposed to weather. Since resistance in a series circuit is cumulative, each successive ring terminal may reduce the ability for electricity to flow, thereby putting excessive load on the circuit, or preventing sufficient electrical flow to the attached loads altogether.

Lastly, an additional major drawback of using multiple adjacent ring terminals in series on the battery terminal or a battery terminal post clamp is it reduces the amount of effective thread available on the battery terminal bolt to grip into the battery terminal and affix the load wires to the battery. FIG. 3 illustrates a cross-section view of the battery terminal 24, the terminal bolt 26 used to affix loads to the battery, with only the primary vehicle load ring terminal 28 affixed. The length of the factory installed terminal bolt 26 allows ample thread grip in the terminal bolt socket 36.

FIG. 4 illustrates the reduced thread grip in terminal bolt socket 36 using the same terminal bolt 26 when several additional ring terminals 30, 32, and 34 are affixed to the battery terminal in addition to the primary load ring terminal 28, thus acting as spacers. Thus the more accessories added, the worse the problem becomes.

While this can be resolved by replacing the original bolt with a longer one, many people installing accessories continue to use the original length bolt as they do not have a correct length bolt handy. Since motorcycles, PWCs, ATVs, and snowmobiles are prone to vibration, a common problem that a battery terminal bolt with inadequate grip range creates is for the bolt to loosen over time, causing the electrical functioning of the vehicle to fail. To prevent this many people attempt to compensate by over-tightening the terminal bolt. Since most terminals are made of lead, which is highly malleable, too much torque can strip the threaded battery terminal bolt socket thereby rendering the battery unusable.

BRIEF SUMMARY

The present disclosure is directed to an electrical power connection device that is directly coupled to the battery of a motor vehicle with a single pair of power input leads, and in turn distributes power to a plurality of accessory loads. The device is sufficiently small in size so as to be usable on motor vehicles such as motorcycles, ATVs, PWCs, and snowmobiles where space available for additional power connection devices is limited. Since the power input leads are flexible, and can be of any length, the portion of the device that receives the accessory's power wires can be located at a convenient place on the vehicle. Once coupled to the battery of the motor vehicle, the device provides the ability to insert or remove power wires of an accessory into the device without disturbing load wires already coupled to the device.

Referring to the embodiment shown in FIG. 5, the device 50 uses pressure from an individual securing mechanism for each wire to both secure the wire into the housing, and to press the wire against the power distribution bus within the housing 52. The securing mechanisms operate via a clamping method, and may be of the type known in the art, but not limited to, as illustrated in FIG. 6 a plurality of cam locking levers 56. An additional embodiment of the device shown in FIG. 7 would use a plurality of rocker style levers 56 which use tension springs to hold the securing mechanisms in the closed position. An additional embodiment as shown in FIG. 8, of the securing mechanisms would use a plurality of thumbscrews 56 to apply the pressure needed to secure the power wires into the device.

The major benefits from the above mentioned style of wire securing mechanisms is they may be used to couple to the device a standard vehicle wire which has been stripped of the insulation, and therefore does not require a specific style of connector at the terminating end of the accessory wire in order to mate with the power connection device. The second major benefit is the securing mechanisms may be activated and deactivated without the use of tools, thus easing installation and removal of accessories. The third benefit of the above mentioned securing mechanisms is they may be constructed of a electrically insulating material so as to shield the uninsulated portion of the accessory power wire, and the electrically conducting mating member of the device from accidental contact with any electrically conducting member of the vehicle.

An additional embodiment of the device allows the device to accept both ring terminals and stripped wires. The device uses a combination of specially shaped terminal receiving sockets, and the securing mechanism to lock the terminals into the device. This allows the user to couple to the device a broad range of accessories without the use of tools.

In accordance with present disclosure, a power connection device for vehicle batteries is provided that includes a housing constructed of an electrically insulating material, and possessing a plurality of pairs of wire receiving sockets, each socket with a corresponding wire securing mechanism member of the housing assembly. The wire receiving socket pairs are arranged longitudinally in the device as two rows. One row exposes a power distribution bus contained within the housing and possessing a negative polarity, the other row exposes another power distribution bus contained within the housing and possessing a positive polarity. The power distribution buses serve as the contact surfaces for the inserted wires.

Each power distribution bus is connected to one of two power input wires which exit the device housing. One of the lead wires pass through a circuit protection device before terminating with a ring terminal of the size appropriate to affix to a battery terminal of the specific vehicle application. The other lead wire terminates with a ring terminal of the size appropriate to affix to a battery terminal of the specific vehicle application.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures or components or both associated with vehicle batteries have not been shown or described in order to avoid unnecessarily obscuring descriptions of the embodiments.

Unless the context requires otherwise, throughout the specification and claim that follow, the word "comprise" and variations thereof, such as "comprises" and "comprising" are construed in an open constructive sense, that is, as "including, but not limited to." The foregoing applies equally to the words "having" and "including". Additionally, the terms "wire", "power wire", "lead wire", and "load wire" are all used to denote any conducting wire or cable, possessing either a positive or a negative polarity, which is used to carry an electrical load used to power an electrical device.

Reference throughout this description to "one embodiment" or "an embodiment" means that a particular feature structure, or characteristic described in connection with the embodiment is included in at least one embodiment. Thus, the appearance of the phrases "in one embodiment" or "in an embodiment" in various places throughout the specification are not necessarily referring to the same embodiment. Furthermore, the particular features, structures, or characteristics may be combined in any suitable manner in one or more embodiments.

Throughout this disclosure the term "vehicle" is intended to encompass ground based, aircraft, and watercraft.

The present disclosure is directed to an electrical power connection device that is directly coupled to the battery of a motor vehicle with a single pair of power leads, and in turn distributes power to a plurality of accessory load wires which are inserted into the device. The device is sufficiently small in size so as to be usable on motor vehicles such as motorcycles, ATVs, PWCs, and snowmobiles where space available for additional power connection devices is limited. The device couples to the battery using flexible lead wires, which also provides flexibility in the location of the output sockets.

Figure 5:
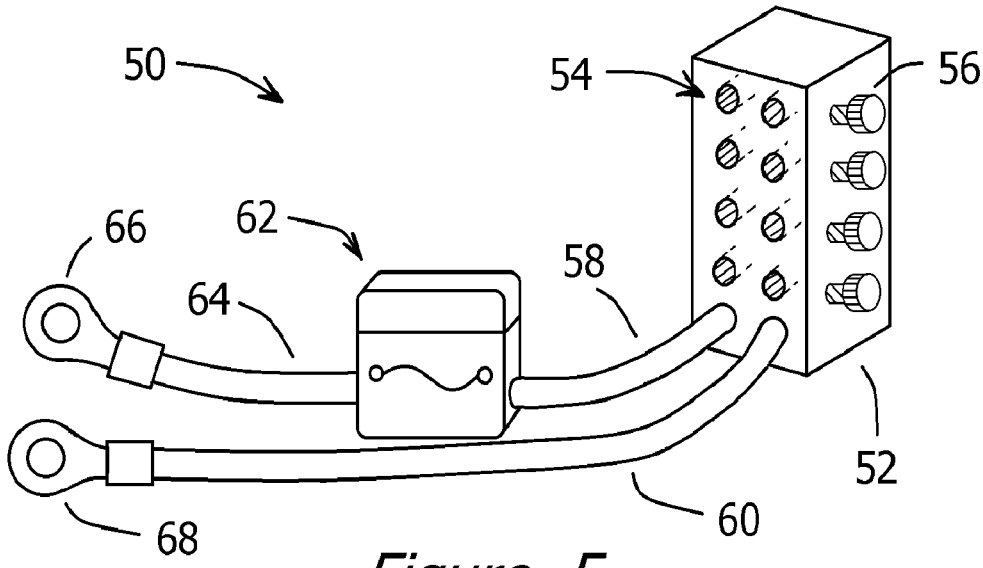
FIG. 5 illustrates a vehicle power connection device to power to a plurality of accessories according to an embodiment of the present disclosure.

Referring to FIG. 5, an electrical power connection device 50 includes a housing 52 formed of an electrically insulating material. The housing has a plurality of sockets 54 formed in the front panel, arranged in two rows so as to form a plurality of socket pairs. Directly adjacent to each socket 54, and accessible from the exterior of the housing is an user activated portion 56 of a clamping arm actuating mechanism. Exiting the housing are two input power wires 58 and 60. Input power wire 58 is coupled to a circuit protection mechanism 62 as is illustrated by, but not limited to a fuse. The other side of the circuit protection mechanism is coupled to power input wire 64. The power input wire 64 terminates with a terminal 66 of the type used to couple to a vehicle battery terminal bolt or a battery terminal clamp. The power input wire 60 terminates with a terminal 68 of the type used to couple to a vehicle battery terminal bolt or a battery terminal clamp.

Figure 9:
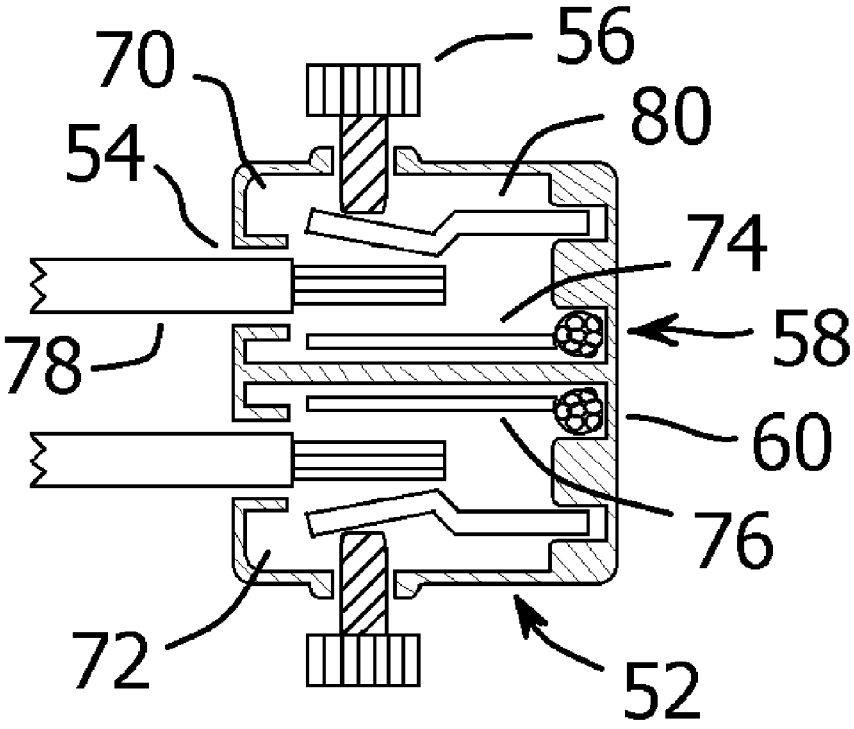
FIG. 9 is a cross-sectional view of the vehicle power connection device to provide power to a plurality of accessories according to an embodiment of the present disclosure.

Referring to FIG. 9, which shows a cross-sectional view of the housing 52, in accordance with another aspect of the device, the housing 52 is formed with two cavities 70 and 72. The housing 52 is formed so that the two cavities 70 and 72 are electrically insulated from each other. Within cavity 70 is a linear metal power distribution bus plate 74 constructed of a conducting material, running the length of the cavity 70, and positioned so each of the sockets 54 in the row on the side of the housing 52 containing cavity 70 expose the power distribution bus 74 to an inserted wire 78. Power input wire 58 is coupled to the power distribution bus 74.

Figure 10:
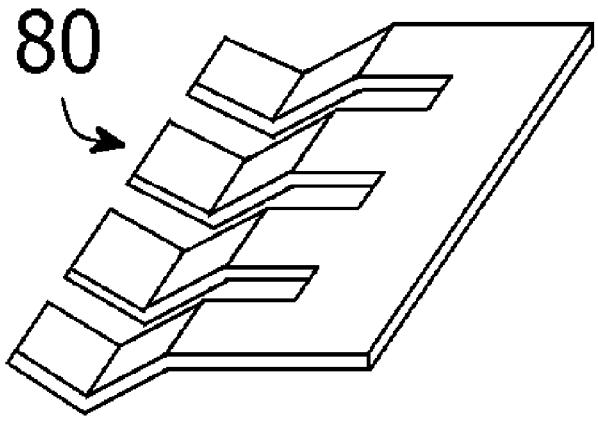
FIG. 10 illustrates one embodiment of the clamping arm member according to an embodiment of the present disclosure.

A plurality of flexible clamping arms 80, are positioned inside the housing 52 parallel to the power distribution bus 74 on the opposite side of the cavity 70 so that the path of the wire through the sockets is unobstructed when no pressure is on the clamping arm 80 from the clamping arm actuating mechanism 56. FIG. 10 illustrates one embodiment of the clamping arms 80.

Cavity 72 and its members are similar in configuration to cavity 70 and its members, however power input wire 60 is coupled to its power distribution bus 76.

Figure 1:
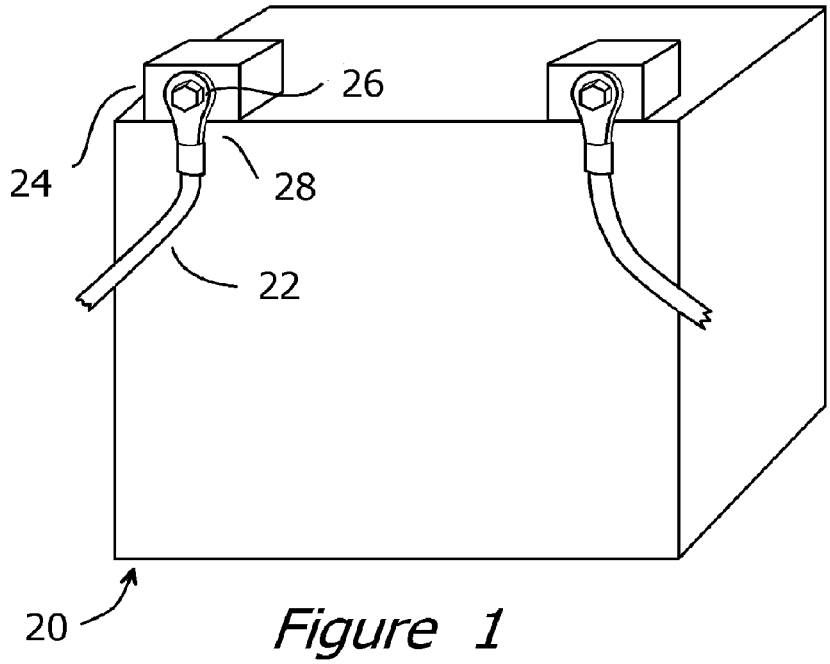
Figure 1 (Prior Art)
FIG. 1 illustrates a vehicle battery wherein a pair of load wires are attached in a known method.
Figure 2:
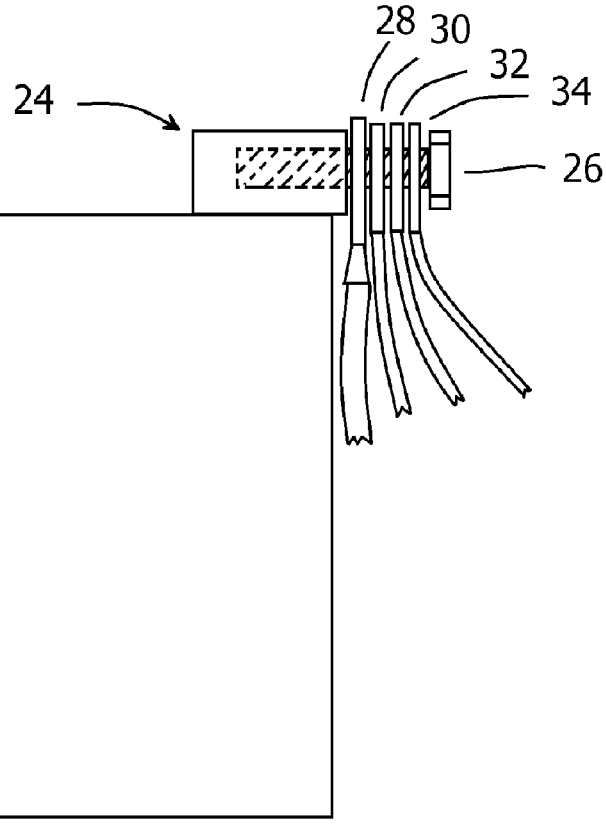
Figure 2 (Prior Art)
FIG. 2 illustrates a side view of the vehicle battery wherein a plurality of load wires are attached to a battery terminal in a known method.
Figure 3:
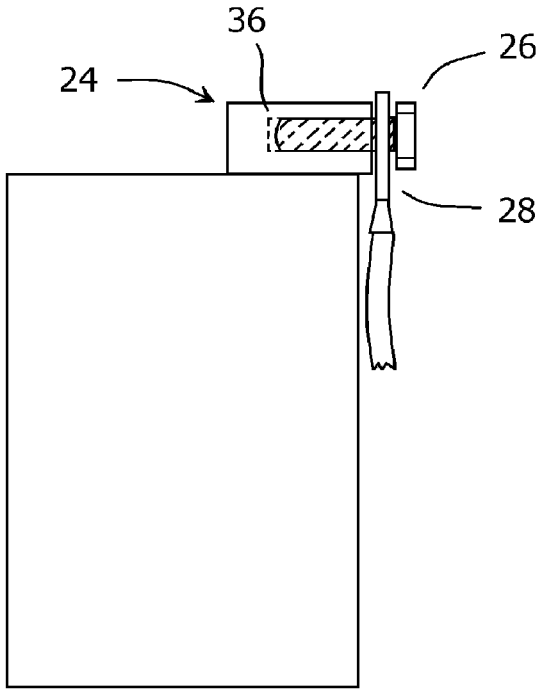
Figure 3 (Prior Art)
FIG. 3 illustrates a side view of the vehicle battery, specifically the mechanical fastening portion securing a load wire.

By way of example, in a negative ground system, the above described device is coupled to the vehicle battery by passing the positive battery terminal bolt through the opening in the device ring terminal 66 shown in FIG. 5, then reinstalling the bolt into the battery terminal as shown in FIG. 3. The negative battery terminal bolt is passed through the opening in the device ring terminal 68, then reinstalled the bolt into the battery terminal.

If the battery is of the type which uses a clamp instead of a terminal bolt to couple the primary vehicle battery cables to the battery, then the device ring terminals 66 and 68 may be coupled to the battery clamps by a similar method using the battery clamp pinch bolt.

Referencing FIGS. 5 and 9, the circuit protection mechanism 62 is coupled in series between the device power input wire 64, and the device power input wire 58 coupled to the power distribution bus 74 contained within housing 52 in order to disconnect the accessory load from the battery if a circuit fault condition occurs. Additionally, the circuit protection mechanism also provides a rapid way to disconnect all the accessory loads from the battery simultaneously.

When the device is coupled to the battery, the row of sockets 54 in the housing 52 which expose the power distribution bus that is electrically coupled to the positive battery terminal, will allow the plurality of wires 78 inserted into that row of sockets 54 to be electrically coupled to the positive battery terminal. The row of sockets 54 in the housing 52 which expose the power distribution bus that is electrically coupled to the negative battery terminal, will allow the plurality of wires 78 inserted into that row of sockets 54 to be electrically coupled to the negative battery terminal.

Figure 4:
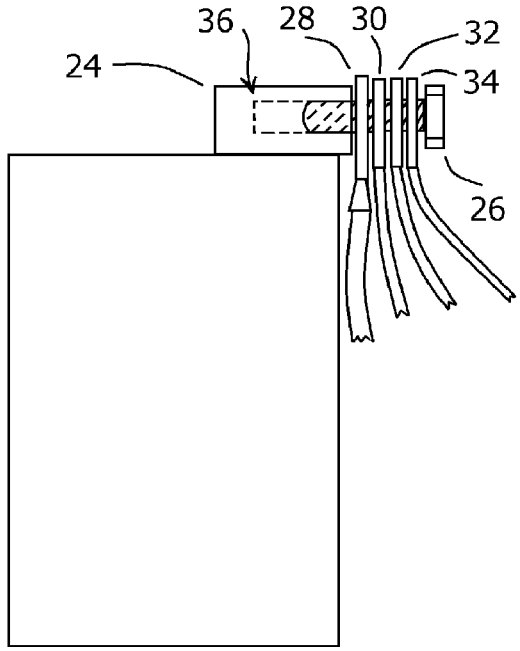
Figure 4 (Prior Art)
FIG. 4 illustrates a side view of a vehicle battery, specifically the mechanical fastening portion securing a plurality of load wires.

Since the coupling of the plurality of wires to the battery is done using a parallel method via the power distribution bus, the quality of the electrical coupling of one wire 78 is not affected by a poor quality connection of another. Thus the quality of the electrical coupling doesn't degrade as additional accessories are added. This also reduces the problems associated with FIG. 4, as only the single pair of terminals 66 and 68 can couple a plurality of accessories to the battery.

The housing 52 is shaped so that no electrically conducting member of the device, or the uninsulated portion of the inserted wires 78 are exposed so as to create an electrical short should the apparatus come into contact with an electrically conducting member of the vehicle. When the clamping arm actuating mechanism 56 is actuated into the secure position, the wires 78 are secured into the device as the clamping arm actuating mechanism 56 associated with each socket 54, presses against the flexible clamping arm 80, which in turn clamps the wire 78 between the flexible clamping arm 80 and the power distribution bus 74. This also creates an electrical coupling between the wire 78 and the power distribution bus 74. By moving the clamping arm actuating mechanism 56 to the release position, the wire 78 can be easily removed. This allows individual wires to be coupled or decoupled from the device without affecting the coupling of other wires inserted in the device.

Figure 6:
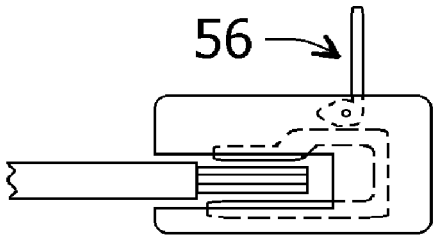
FIG. 6 is a cross-sectional view of a wire securing mechanism using a cam lever as an actuating mechanism.
Figure 7:
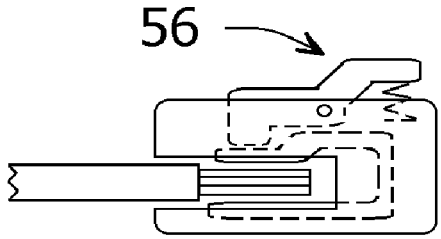
FIG. 7 is a cross-sectional view of a wire securing mechanism using a spring lever as an actuating mechanism.
Figure 8:
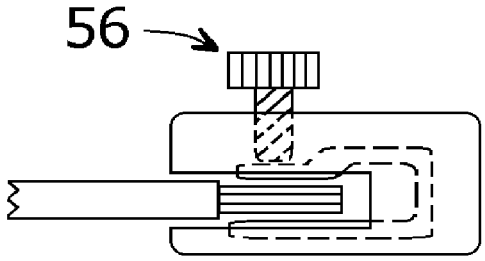
FIG. 8 is a cross-sectional view of a wire securing mechanism using a thumbscrew as an actuating mechanism.

Various wire securing mechanisms are represented by, but not limited to FIGS. 6, 7, and 8. The two common design attributes of the securing mechanisms is they can be actuated by hand without the use of tools, thus improving the usability of the device, and that they electrically isolate the electrical members inside the housing 52 from the exterior of the housing.

Figure 11:
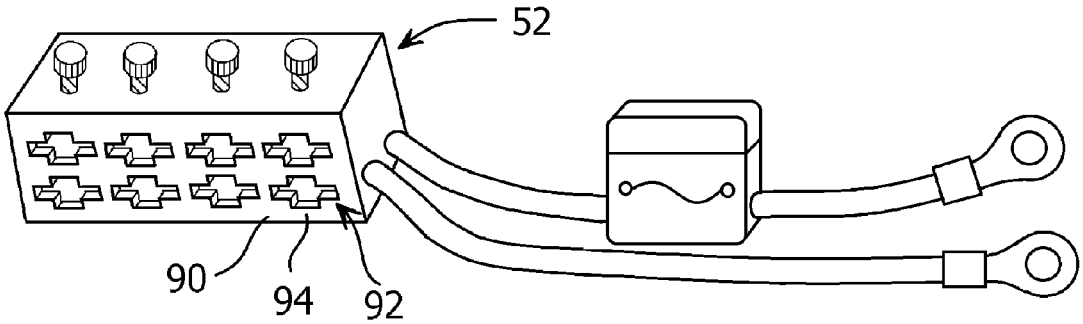
FIG. 11 illustrates an embodiment of the device which can accommodate both stripped wires and ring terminals.

In accordance with another embodiment of the present disclosure, each socket of the device possesses the ability to couple with either stripped wires as shown above, or wires with ring terminals, as are commonly used to couple accessories directly to battery terminals. FIG. 11 shows the housing 52 having a plurality of openings 90 formed therein, which are located on the device in a manner similar to the sockets 54 in FIG. 5 of the above mentioned embodiment. The openings 90 in this embodiment are in the shape of a cross formed of two dissimilarly shaped rectangles. A wide thin rectangle 92 slightly larger than the outside diameter of the width of a ring terminal is perpendicular to a squarer rectangle 94.

Figure 12:
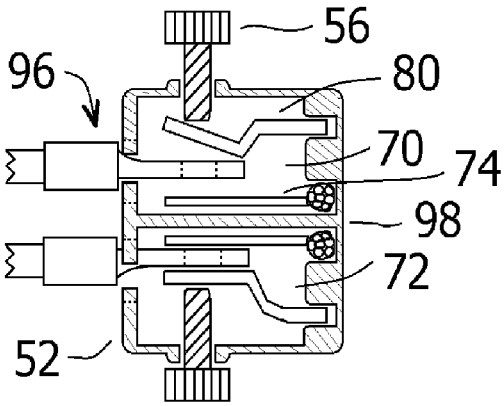
FIG. 12 is a cross-sectional view of the securing mechanism of an embodiment of the device which can accommodate either stripped wires and ring terminals.

A stripped wire is inserted into an opening 90, and is secured into the housing 52 in the same manner as the previously described embodiment. Referring to FIG. 12, a wire end possessing a ring terminal 96 is inserted into the wide thin rectangular portion of the opening 92 shown in FIG. 11. FIG. 12 shows the ring terminal 96 after it has been inserted into the cavity 70, but before the securing mechanism 56 and flexible clamping arm 80 have clamped the ring terminal 94 to the power distribution bus 74.

Figure 13:
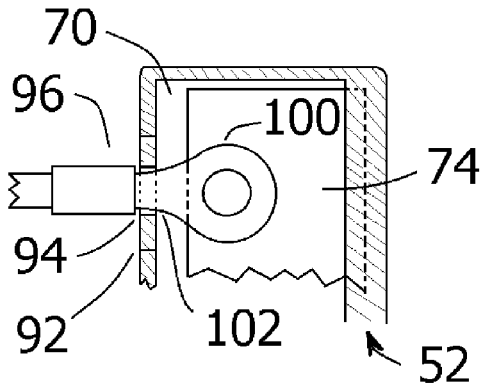
FIG. 13 is a top view of the securing mechanism of an embodiment of the device which can accommodate either stripped wires and ring terminals.

FIG. 13 shows a top cutaway view of the housing 52 and that the ring terminal 96 is able to be inserted as the widest portion 100 of the ring terminal 96 is narrower than the wider portion of the opening 92. Once the securing mechanism is actuated into the secure position, the ring terminal 96 is clamped against the power distribution bus 74 which is stationary in the housing 52. This forces the ring terminal 96 to change its position in the cavity 70 so it is now immediately adjacent to the stationary power distribution bus 74. FIG. 12 shows a cavity 72 of the housing 52 wherein the device members of cavity 72 are in the secure position.

In addition to securing the ring terminal 96 into the housing 52 through the use of pressure created by the clamping method, the design of the opening 90 employs an additional securing method when the device is used with ring or fork terminals. Once the ring terminal 96 is immediately adjacent to the power distribution bus 74, it is no longer aligned with the widest portion of the opening 92 through which it entered. It is now aligned with the narrower portion of the opening 94. While the narrower portion of the opening 94 is wide enough to accommodate the narrow portion of the ring terminal 102, it is narrower than the wider portion of the ring terminal 100. This prevents the ring terminal 96 from being removed from the housing 52 when in the secure position.

Figure 14:
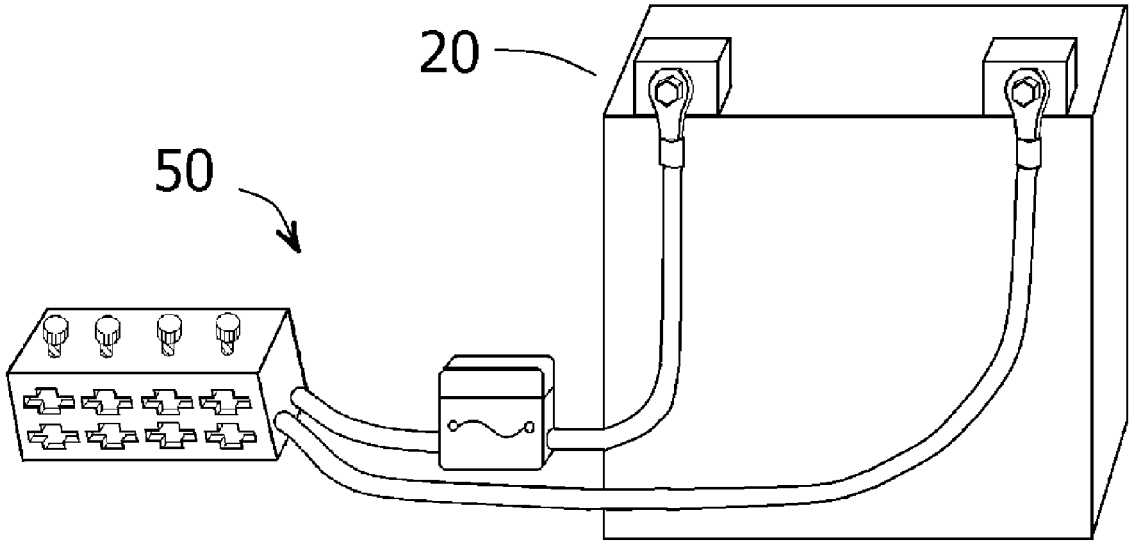
FIG. 14 illustrates an embodiment of the device when coupled to the vehicle battery.

FIG. 14 illustrates the device 50 when coupled to the vehicle's battery 20.

These and other changes can be made to the embodiments in the power connection device of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A power connection device for electrically coupling to a motor vehicle battery in order to distribute power to a plurality of loads, the device comprising;

a housing having a front, back, top and bottom panels, the housing having two internal cavities formed by a central electrically insulating dividing wall along a central axis and parallel to the top and bottom panels, the front panel having a plurality of openings formed therein and arranged in two rows along the central axis, the first row of openings exposing one of the cavities inside of the housing, the second row of openings exposing the other cavity inside of the housing, the housing having two additional openings formed therein to accommodate two power input wires, the housing formed of a electrically insulating material;

a pair of linear metal bus plates positioned inside the housing, each of said plates having a length, width, and depth, the length and width defining a substantially rectangular shape, the two rectangular plates arranged approximately parallel to each other, separated by and immediately adjacent to the central wall that divides the interior of the housing into two cavities, each plate positioned within their respective housing cavities to align approximately parallel with the top and bottom panels;

a plurality of clamping arms positioned inside the housing in a one-to-one ratio to the number of openings in the housing excluding the two power input wire openings, each clamping arm associated with an opening, the clamping arms positioned so a wire inserted into the opening can be clamped between the bus plate and the clamping arm associated with said opening;

a plurality of clamping arm actuating mechanisms in a one-to-one ratio to the number of clamping arms, each actuating mechanism associated with a clamping arm and positioned in the housing so as to put sufficient pressure on the clamping arm when the mechanism is actuated to force the clamping arm against the bus plate, a portion of the actuating mechanism is exposed on the exterior of the housing so as to provide a mechanism activation interface for the user;

a first wire electrically coupled to the first bus plate, the wire exiting the device housing via the first power input wire openings, the portion of the wire being external to the housing possessing an electrical insulation, the wire being sufficient in length to provide adequate location flexibility in placement of the housing for the given vehicle application, the end of the wire not coupled to the bus plate terminating with a terminal of the type used to attach a load to a vehicle battery terminal;

a second wire electrically coupled to the second bus plate, the second wire exiting the device housing via the second power input wire, the portion of the second wire being external to the housing possessing an electrical insulation, the wire being sufficient in length to provide adequate location flexibility in placement of the housing for the given vehicle application, the end of the wire not coupled to the bus plate terminating with a terminal of the type used to attach a load to a vehicle battery terminal; and a circuit protection mechanism electrically coupled serially to one of the insulated wires, the mechanism being able to break electrical communication between the device and the vehicle power source should the load exceed the specified rating.

2. The device of claim 1 wherein the device is coupled to the vehicle's wiring harness instead of the vehicle's battery.

3. The device of claim 1 wherein the individual shape of each of the openings formed in the housing possesses a wide portion to allow a wire terminating with a ring terminal, or a fork terminal to be received into the housing through the opening, and a narrow portion so that the ring or forked terminal is unable to be removed from the device when the position of the terminal is aligned with the narrow portion of the opening, as when occurs when the terminal is clamped against the bus plate.

4. The device of claim 3 wherein the device is coupled to the vehicle's wiring harness instead of the vehicle's battery.

5. The device of claim 3 wherein the individual shape of the members of some, but not all of the pairs of openings formed in the housing are shaped with only a narrow portion so as to only accept a stripped wire rather than a ring or fork terminal.

6. The device of claim 5 wherein the device is coupled to the vehicle's wiring harness instead of the vehicle's battery.

* * * * *